US009604374B2

(12) United States Patent
Burgio et al.

(10) Patent No.: US 9,604,374 B2
(45) Date of Patent: Mar. 28, 2017

(54) METHOD OF MAKING A LUBRICATION BOX FOR A WET SHAVING IMPLEMENT

(75) Inventors: Paul Burgio, St. Paul, MN (US); Gordon Krauss, Ann Arbor, MI (US); Janet Coope-Epstein, Norwalk, CT (US); Wayne Hobson, Sr., Shelton, CT (US)

(73) Assignee: Edgewell Personal Care Brands, LLC, Chesterfield, MO (US)

( * ) Notice: Subject to any disclaimer, the term of this patent is extended or adjusted under 35 U.S.C. 154(b) by 1016 days.

(21) Appl. No.: 12/909,005

(22) Filed: Oct. 21, 2010

(65) Prior Publication Data

US 2011/0099815 A1 May 5, 2011

Related U.S. Application Data

(60) Provisional application No. 61/253,540, filed on Oct. 21, 2009.

(51) Int. Cl.
*B26B 21/44* (2006.01)

(52) U.S. Cl.
CPC ..... *B26B 21/44* (2013.01); *Y10T 29/4998* (2015.01)

(58) Field of Classification Search
CPC ..... B29C 35/0261; Y10T 83/04; B32B 37/00; B32B 37/0023; B32B 37/14; B26B 21/40; B26B 21/44; B26B 21/443
(Continued)

(56) References Cited

U.S. PATENT DOCUMENTS 3,717,427 A * 2/1973 Bodine ..... B01J 19/10 264/443
4,381,293 A * 4/1983 Michel ..... B26B 21/44 30/537
(Continued)

FOREIGN PATENT DOCUMENTS

EP 0885698 A1 * 12/1998 ..... B26B 21/38
JP 03049794 A * 3/1991 ..... B26B 21/22
(Continued)

OTHER PUBLICATIONS

Amsh. "Production of Ultrasonic Waves Using Piezoelectric Generator." Winner Science. WordPress, Mar. 27, 2013. Web. Jan. 14, 2017.*

*Primary Examiner* — Stephen F Gerrity
(74) *Attorney, Agent, or Firm* — Edgewell Personal Care Brands, LLC

(57) ABSTRACT

According to one aspect of the present invention, a lubrication box includes a first portion, a shaving aid material, and a second portion. The first portion of the lubrication box has a skin-engaging surface and at least one sidewall that, together, form a cavity. The skin-engaging surface includes at least two holes therethrough. The shaving aid material, which is optionally distributed in the cavity in a series of layers, is ultrasonically compressed into the cavity such that it at least partially fills at least one of the holes in the skin-engaging surface and at least a portion of the cavity. The second portion of the lubrication box is attached to the first portion such that the cavity is substantially closed. A gap exists between in the cavity between the shaving aid and the second portion of the lubrication box to permit the shaving aid material to expand during normal use.

20 Claims, 10 Drawing Sheets

(58) Field of Classification Search
USPC ..... 30/41, 50; 29/527.1
See application file for complete search history.

(56) References Cited

U.S. PATENT DOCUMENTS

| | | | | |
|---|---|---|---|---|
| 4,624,051 | A * | 11/1986 | Apprille et al. | 30/50 |
| 4,944,090 | A * | 7/1990 | Sumnall | B26B 21/44 30/41 |
| 5,134,775 | A * | 8/1992 | Althaus et al. | B26B 21/44 30/41 |
| 5,180,240 | A * | 1/1993 | Gueret | B65B 1/24 401/200 |
| 5,888,645 | A * | 3/1999 | Lindgaard et al. | B29C 35/0261 264/442 |
| 5,903,979 | A * | 5/1999 | Oldroyd | 30/41 |
| 6,115,902 | A * | 9/2000 | Garland et al. | B26B 21/443 29/417 |
| 6,298,558 | B1 * | 10/2001 | Tseng et al. | 30/41 |
| 6,851,190 | B2 * | 2/2005 | Guimont et al. | 30/41 |
| 7,103,977 | B2 * | 9/2006 | Guimont | 30/41 |
| 7,111,400 | B2 * | 9/2006 | Guimont et al. | 30/41 |
| 7,574,802 | B2 * | 8/2009 | Pennella | 30/41 |
| 2002/0127310 | A1 * | 9/2002 | Capodieci | A23P 30/10 426/238 |
| 2004/0010918 | A1 * | 1/2004 | Orloff et al. | B26B 21/44 30/41 |
| 2004/0181943 | A1 * | 9/2004 | Kwiecien | 30/41 |
| 2005/0120559 | A1 * | 6/2005 | Bressler et al. | B26B 21/44 30/41 |
| 2005/0123342 | A1 * | 6/2005 | Bressler et al. | B26B 21/446 401/263 |
| 2005/0126008 | A1 * | 6/2005 | Pennella et al. | B26B 21/446 30/41 |
| 2006/0193914 | A1 * | 8/2006 | Ashworth et al. | A61K 9/2031 424/469 |
| 2006/0254056 | A1 * | 11/2006 | Coffin et al. | B26B 21/44 30/41 |
| 2010/0122462 | A1 * | 5/2010 | Ndou et al. | B26B 21/443 30/41 |
| 2012/0023749 | A1 * | 2/2012 | Ariyanayagam et al. | B26B 21/44 30/34.2 |
| 2012/0023750 | A1 * | 2/2012 | Blatter et al. | B26B 21/44 30/41 |
| 2012/0023763 | A1 * | 2/2012 | Ariyanayagam et al. | B26B 21/44 30/537 |
| 2013/0153135 | A1 * | 6/2013 | Burgio et al. | B26B 21/44 156/242 |

FOREIGN PATENT DOCUMENTS

| | | | | |
|---|---|---|---|---|
| JP | 2004321322 | A * | 11/2004 | B26B 21/44 |
| WO | WO 9613360 | A1 * | 5/1996 | B26B 21/443 |
| WO | WO 2005018884 | A2 * | 3/2005 | B26B 21/443 |

* cited by examiner

METHOD OF MAKING A LUBRICATION BOX FOR A WET SHAVING IMPLEMENT

CROSS REFERENCE TO RELATED APPLICATIONS

This application claims benefit of U.S. Provisional patent application No. 61/253,540, filed Oct. 21, 2009, incorporated herein by reference in its entirety.

BACKGROUND OF THE INVENTION

1. Field of Endeavor

The present invention is generally directed to a lubrication box for a wet shaving implement in general and, more particularly, to a mechanically assembled lubrication box that provides lubrication during shaving.

2. Background Information

Wet shaving implements generally consist of a shaving cartridge, also commonly known as a razor cartridge, and a handle. The shaving cartridge can be fixedly, or pivotally, attached to the handle. In addition, the shaving cartridge might be affixed to the handle such that, after several uses, a spent shaving cartridge can be replaced with a new shaving cartridge on the same handle. Such handles and shaving cartridges are often referred to as "system razors." Alternatively, the shaving cartridge can be affixed to the handle such that it is not intended to be removed from the handle during normal use and, once the shaving cartridge is spent, the entire shaving implement is discarded and an entirely new shaving implement is used in the now-discarded shaving implement's place. Such shaving implements are often referred to as "disposable razors."

Shaving cartridges generally include a guard, a cap, and at least one blade. Prior art guards are located forward of the blade(s) and acts to flatten and/or pre-stretch the skin prior to encountering the blade. Prior art caps are often located aft of the blade(s) and, in addition to flattening the skin after the skin has been shaved, can also provide lubrication and/or other shaving aids to the recently-shaved skin. Typically, the lubrication and/or shaving aids are provided by a lubrication strip that is affixed to the cap.

In many cases, these lubrication strips utilize two components: a water soluble component that is dispersed throughout a water insoluble matrix. The water insoluble matrix maintains the integrity of the lubrication strip during normal use, permitting water soluble components to dissolve in the water present during normal shaving. Once dissolved in water, the water soluble shaving aid leaches onto the surface to be shaved, providing a shaving benefit. These lubrication strips are typically adhered to or mechanically fastened to the wet-shave razor cartridge.

These forms of lubrication strips have deficiencies. At first, the shaving aid tends to leach superfluously during first few shaves. However, the amount of water soluble shaving aid lessens with each subsequent shave, thereby dissipating and often outlasted by the other components of the razor cartridge. Accordingly, the last several shaves also provide insufficient lubrication to the surface being shaved. Furthermore, current insoluble matrices do not permit complete leaching of all shaving aid, and are thus wasteful.

Other wet-shave razors embed lubrication elements, such as U.S. Pat. No. 5,711,076 to Tseng (hereinafter referred to as "Tseng"), teach a co-extruded core and sheath set-up, where the water soluble core is co-extruded with a water insoluble sheath. The sheath portion of Tseng includes holes through which dissolved core material leaches during normal shaving. However, Tseng, and similar lubrication devices also have deficiencies. These deficiencies include, among others, limited flexibility due to the co-extruded/co-molded manufacturing process; high temperatures and pressures required in extrusion and molding processes that tend to degrade the active shaving aid ingredients; and the fact that the co-molded/co-extruded set-up provides substantially problems when the core swells during normal use.

Accordingly, it is an object of the present invention to provide a lubrication agent and method of manufacture that improves the effectiveness and life expectancy of lubrication agents.

DISCLOSURE OF THE INVENTION

According to one aspect of the present invention, a lubrication box includes a first portion, a shaving aid material, and a second portion. The first portion of the lubrication box has a skin-engaging surface and at least one sidewall that, together, form a cavity. There are at least two holes extending through the skin-engaging surface of the first portion. The shaving aid material is ultrasonically compressed (a.k.a., ultrasonically compacted) into the cavity such that it at least partially fills at least one of the holes in the skin-engaging surface and at least a portion of the cavity. The second portion of the lubrication box is attached to the first portion such that the cavity is substantially closed. A gap exists between in the cavity between the shaving aid and the second portion of the lubrication box to permit the shaving aid material to expand during normal use.

According to another aspect of the invention, the shaving aid is distributed into the cavity in a series of layers (e.g., first, second, third, or more).

According to a further aspect of the present invention, the various layers of shaving aid can be of the same or different color, amount and/or chemical composition as one or more of the other layers of shaving aid.

According to an even further aspect of the present invention, the second portion of the lubrication box can include support structures that extend into the cavity to a position near or directly in contact with the shaving aid.

These and other aspects of the present invention are achieved by the apparatus and method of making the present invention disclosed herein. The invention will be clear to one of skill in the art in light of the Detailed Description and Drawings provided.

BRIEF DESCRIPTION OF THE SEVERAL VIEWS OF THE DRAWINGS

FIG. 58 depicts a further embodiment of the second portion of the lubrication box of FIG. 3;

FIG. 68 depicts a further step in the method of making a lubrication box;

DETAILED DESCRIPTION OF THE INVENTION

Referring to FIGS. 1, 1A, 18, and 1C several embodiments of the shaving cartridge 102 of the present invention are shown. The shaving cartridge 102 of the present invention includes at least a frame 104, at least one razor blade 106, and a lubrication box 108.

Figure 2:
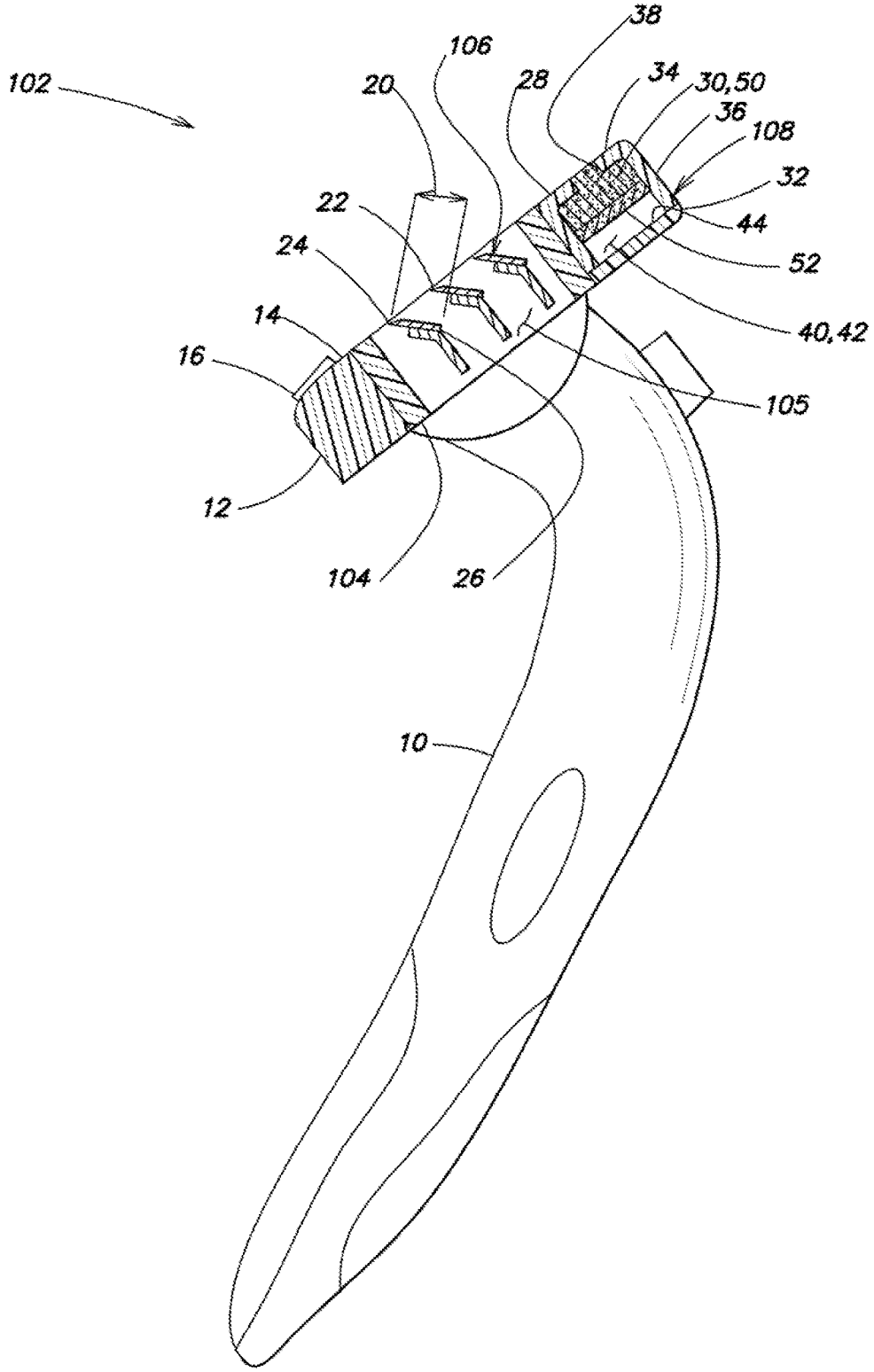
FIG. 2 depicts a cross-sectional view along line I-I of the cartridge of FIG. 1 on a razor handle.

The shaving cartridge 102 of the present invention is often used in conjunction with a handle 10 (see e.g., FIG. 2). The handle 10 is connected to the shaving cartridge 102, either pivotally or fixedly. The handle 10 can be connected to the shaving cartridge 102 in any suitable manner. For example, the handle 10 can be permanently connected to the razor cartridge 102, as is well known in disposable wet shaving implements. Alternatively, the handle can be selectively detachable from the shaving cartridge, as is well known in system wet shaving implements. The handle 10 can be made of any suitable materials and is, typically, ergonomically shaped such that it is easy to hold by the end user during shaving.

The shaving cartridge 102 of the present invention includes a frame 104 and at least one blade 106. The frame 104, which can be made of one or more distinct pieces, typically forms an opening 105 sized to accommodate razor blade(s) 106 (discussed infra.). In some embodiments, such as the one shown in FIG. 1, the frame 104 includes a guard 12 in front of the blades 106. In these embodiments, the guard 12 can be of any suitable type known in the art.

The frame 104 can be made of any suitable material. Molded polymeric materials, or plastics, have proven to be the most effective. The frame 104 is also often either permanently connected to a handle 10 or includes connectors (not shown) such that a user can selectively attach and detach the cartridge from a handle 10.

The guard 12 is, generally, disposed lengthwise on the frame forward of the blades 106 and includes an outer skin-engaging surface 14. The guard 12 may be made of any suitable material known (e.g., rubber) to those of skill in the art and may include additional elements, such as one or more protrusions 16 that flex when in contact with the skin during normal shaving. The guard 12 generally stretches, flattens and otherwise prepares the skin prior to the skin encountering the sharpened blade tips 22. Guards 12 are well known in the art and will therefore not be discussed in detail further herein other than to point out that the present invention is not limited to being used with any particular type of guard 12.

The opening 105 in the frame 104 is sized and shaped to accommodate razor blades 106 positioned therein. Any suitable number of blades 106 (e.g., one, two, three, four, five, six or more) can be positioned within the opening 105 of the frame 104. Generally, the opening 105 is larger in shaving cartridges 102 having more blades 106, and smaller for shaving cartridges 102 having fewer blades 106. Each blade 106 is generally planar and defines a length 18 and a width 20 and is disposed in the opening 105 of the frame 104 such that the sharpened blade tip 22 is appropriately angled for shaving. In embodiments having more than one blade 106, the blades 106 are generally positioned in parallel relation to one another between the front 58 and rear 60 of the frame 104. Each of the blades 106 has a front side 24 and a rear side (not shown) that extend along the length 18 of the blade 106 on opposing sides. A sharpened blade tip 22 extends along at least a portion of a blade 106 width 20 on the front side 24. Each blade 106 is disposed on the frame 104 such that the sharpened blade tip 22 of each blade 106 is located substantially near the shave plane. In other words, the sharpened blade tip 22 of each blade 106 may be substantially contiguous with, slightly above, or slightly below the shave plane. Furthermore, each blade 106 may be mounted on the frame 104 such that the sharpened blade tip 22 is movable relative to the shave plane under forces encountered during normal shaving. For example, in some embodiments, the sharpened blade tip 22 may be located above the shave plane when the shaving cartridge 102 is at rest, but may deflect to a position below the shave plane under the forces on the blade 106 during normal shaving. The location of each blade 106 relative to the shave plane is independent to the location of each of the other blade(s) 106 relative to the shave plane.

Typically, blades 106 are made of flexible material and are supported in the frame 104 to prevent, or at least somewhat inhibit, flexing of the blades 106 during normal shaving. Several manners for supporting the blades 106 are known in the art. For example, in some embodiments, each blade 106 may be welded to a bent blade support (see e.g., FIG. 2) that provides a rigid support structure to the blades 106.

Figure 1:
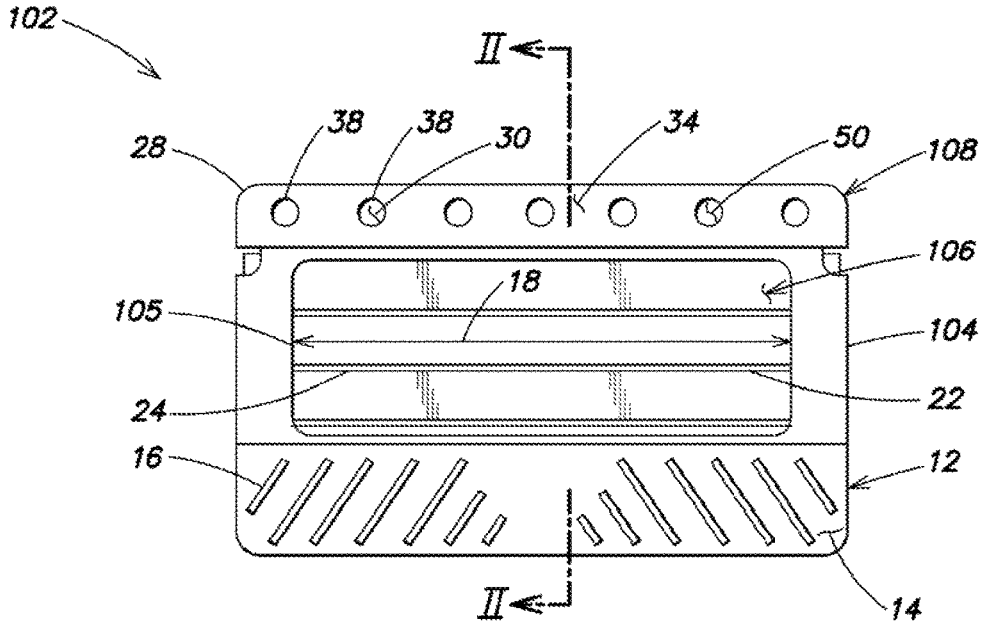
FIG. 1 depicts a front view of one embodiment of a wet shaving cartridge of the present invention.
Figure 1A:
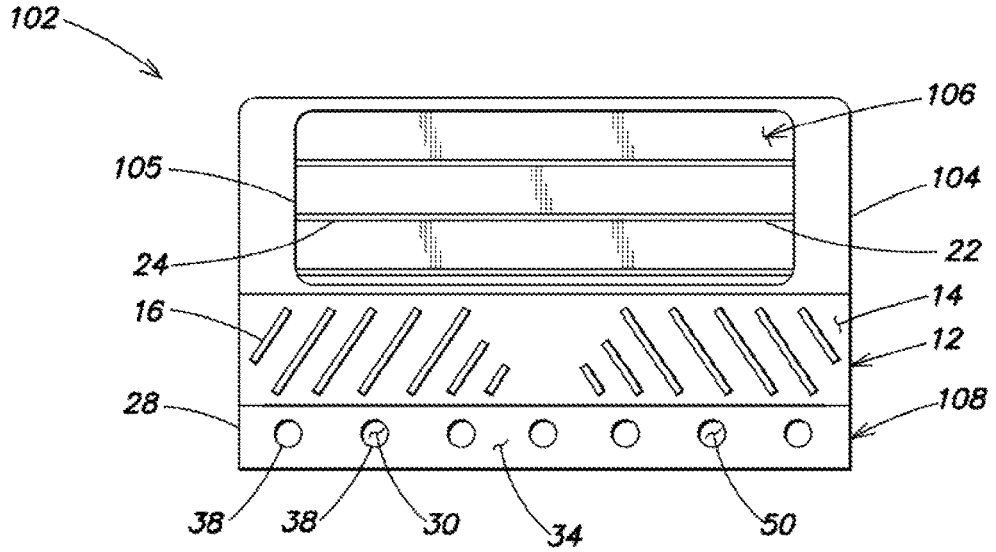
FIG. 1A depicts a front view of another embodiment of a wet shaving cartridge of the present invention.
Figure 1B:
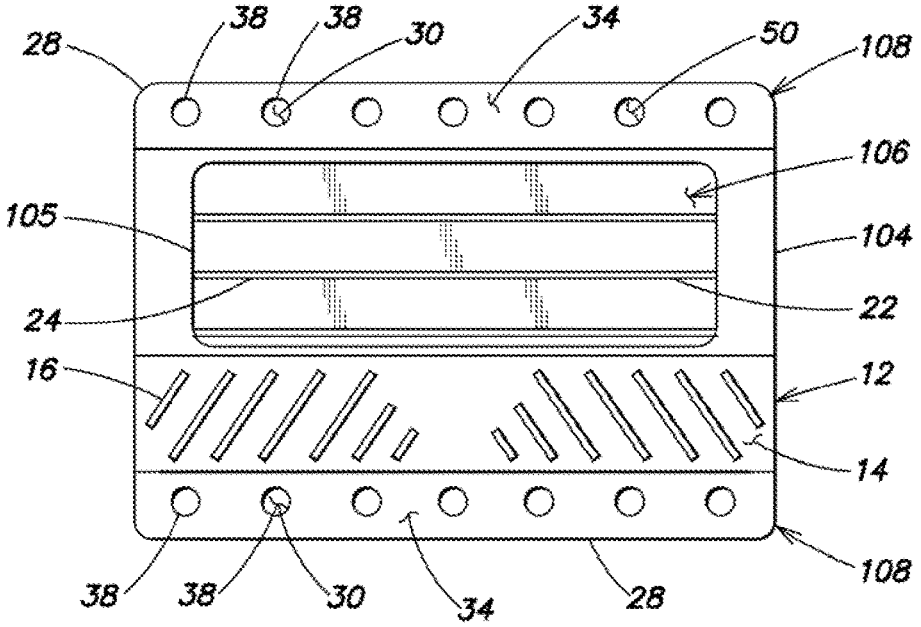
FIG. 1B depicts a front view of a further embodiment of a wet shaving cartridge of the present invention.
Figure 1C:
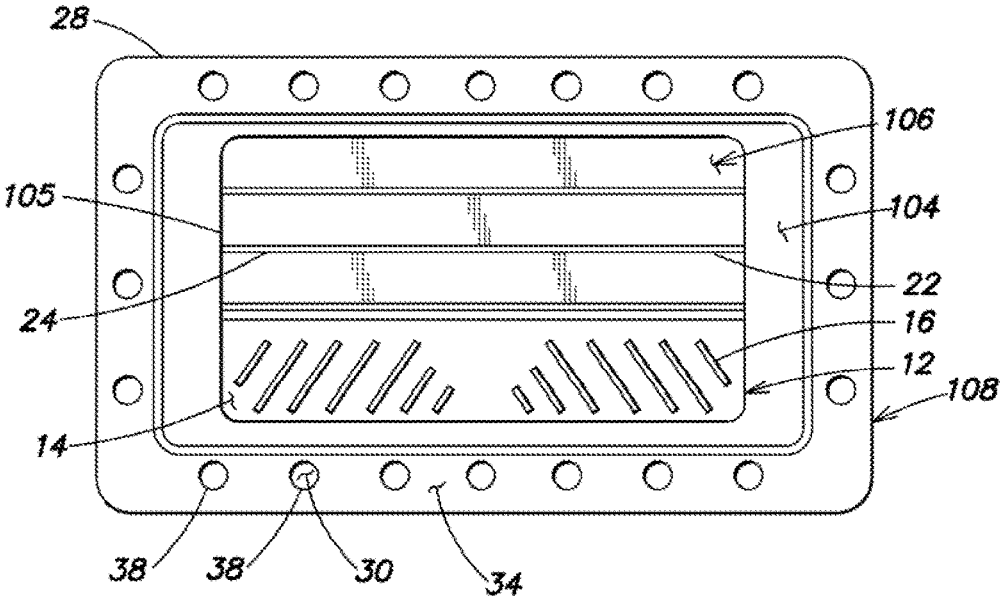
FIG. 1C depicts a front view of an even further embodiment of a wet shaving cartridge of the present invention.

Referring to, e.g., FIGS. 3, 4, 4A and 4B, according to one embodiment of the present invention, a lubrication box 108 includes a first box portion 28, a shaving aid 30, and a second box portion 32. One embodiment of the lubrication box 108 of the present invention is shown, separate from the frame 104, in FIG. 2. The lubrication box 108 is attached to the frame 104, directly or indirectly. For example, as shown in FIG. 1, the lubrication box 108 can be located aft of the blade(s) 106. Or, as shown in FIG. 1A, in other embodiments, the lubrication box 108 can be located forward of the blade(s) 106. In further embodiments, as shown in FIG. 1B, the lubrication box 108 can be located forward and aft of the blade(s) 106. And, in even further embodiments, as shown in FIG. 1C, the lubrication box 108 can substantially surround the blade(s) 106.

Figure 3:
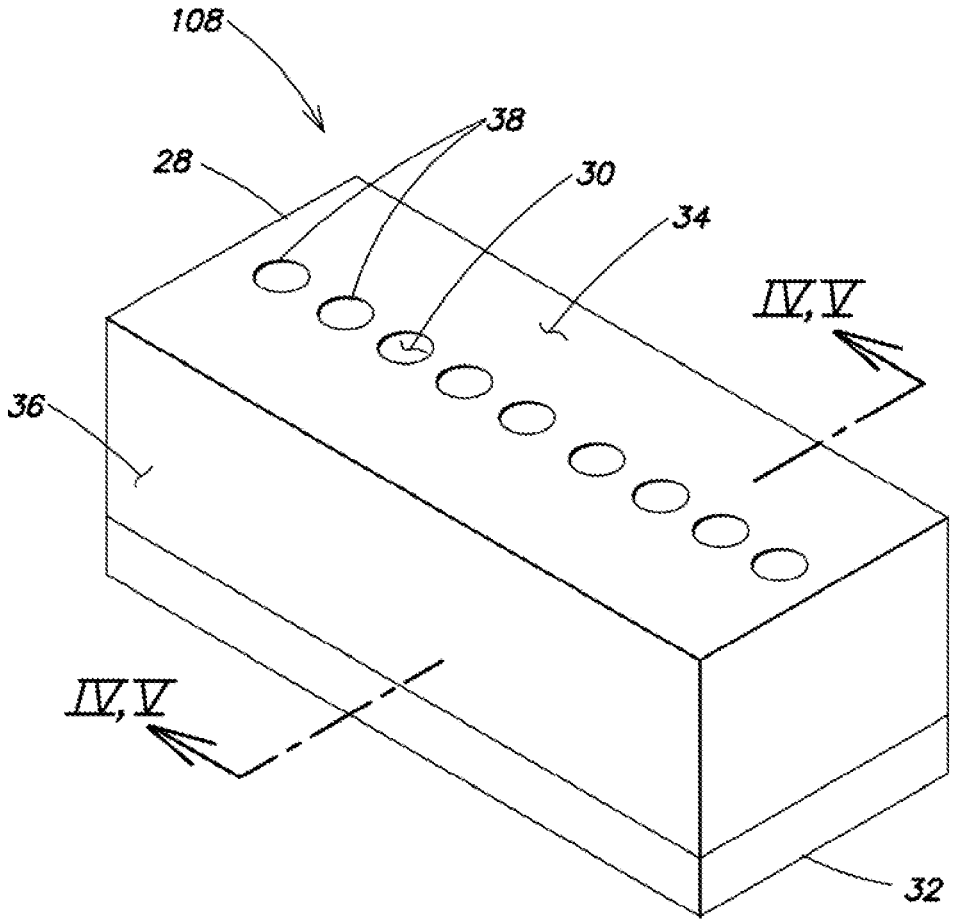
FIG. 3 depicts an isometric view of one embodiment of a lubrication box of the present invention.
Figure 4:
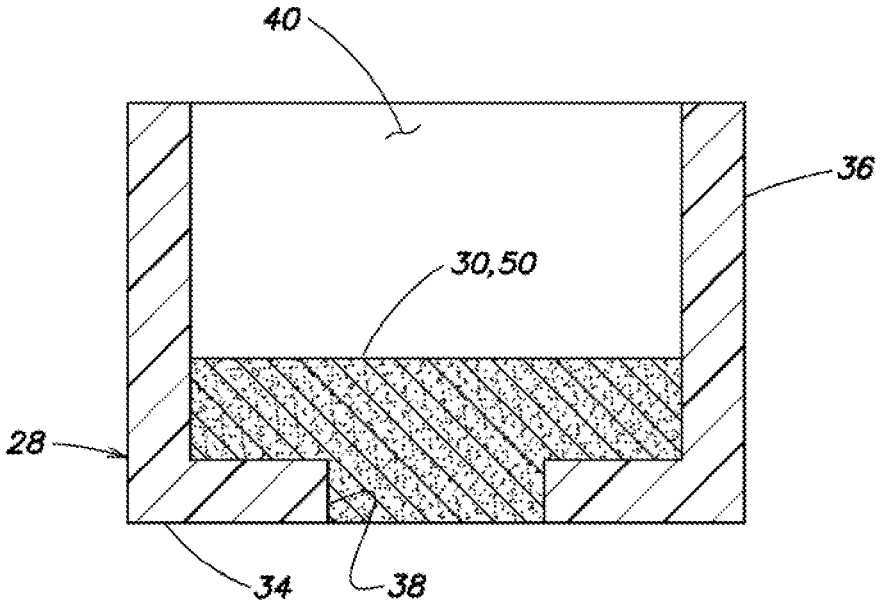
FIG. 4 depicts a cut-away view along line IV-IV of the first portion of the lubrication box of FIG. 3 with a first layer of shaving aid therein.
Figure 4A:
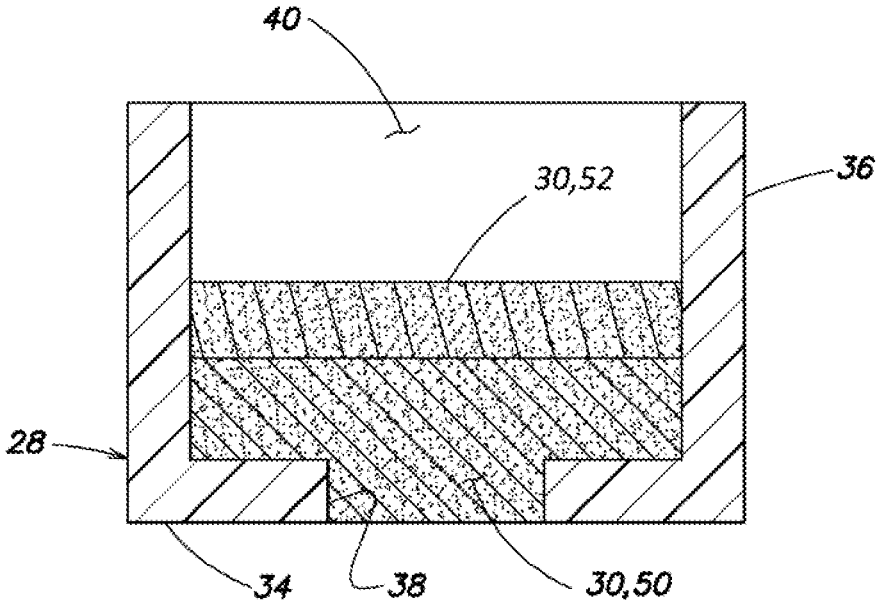
FIG. 4A depicts a cut-away view along line IV-IV of a second layer of shaving aid in the first portion of the lubrication box of FIG. 4.
Figure 4B:
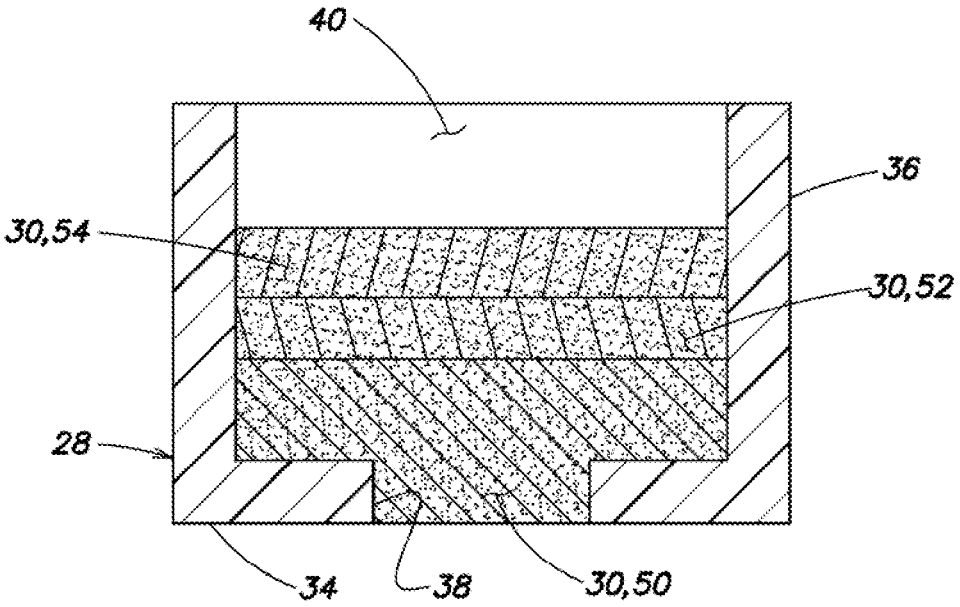
FIG. 4B depicts a cut-away view along line IV-IV of a third layer of shaving aid in the first portion of the lubrication box of FIG. 4A.

One embodiment of the first portion 28 of the lubrication box 108 can be seen in FIG. 3. The first portion 28 includes a skin-engaging surface 34 and at least one side wall 36 that extend(s) from the skin-engaging surface 34 to create a cavity 40. The skin-engaging surface 34 can be of any suitable shape and size and includes at least two holes 38 extending into the cavity. As shown in FIGS. 1, 1A and 1B, the skin-engaging surface 34 can be generally rectangular and is approximately 3 mm in width and approximately 40 mm in length. Alternatively, as shown in FIG. 1C, the skin-engaging surface 34 can be generally oval with a center hole through which a shaving cartridge 102 can pass. However, the present invention is not limited by the shapes and/or size shown and disclosed, and can be of any shape suitable to the designer. Likewise, the at least two holes 38 can be of any suitable size and shape, depending on the needs and wants of the designer. Although the at least two holes 38 are shown in the FIGS. as being in a single row, they can be arranged in any suitable pattern, including multiple rows, and symmetrical and asymmetrical patterns. The first portion 28 can be made of any suitable material, including, but not limited to, plastics, metals, and rubber. Preferably, the entire first portion 28 is a unitary piece made from a single piece of material; however, the present invention is not so limited. For example, although not shown, the skin-engaging surface 34 can be made of a different material than the sidewall(s) 36.

The sidewall(s) 36 extend from skin-engaging surface 34 to create a cavity 40. As shown, for example, in FIGS. 1-1C, the sidewall(s) 36 can extend generally at a right angle to the skin-engaging surface 34, but one of skill in the art recognizes that the present invention is not so limited. For example, the skin-engaging surface 34 could gently transition into the sidewall(s) 36 via a smooth curve so that the edge of the lubrication box 108 gently flattens to the user's skin during normal shaving. The sidewall(s) 36 can be of any suitable height, depending on the needs and wants of the designer. As shown in FIGS. 2 and 3, the sidewall(s) 36 are approximately 4 mm in height, creating a cavity 40 that has a volume of approximately 480 $mm^3$, not including the volume of the at least two holes 38.

A first layer of shaving aid 50 is ultrasonically compressed into the first portion 28 of the lubrication box 108 such that the first layer of shaving aid 50 is compacted in at least a portion of the cavity 40 and, preferably, compacted such that a portion of the first layer of shaving aid 50 substantially fills at least one of the holes 38. Even more preferably, the first layer of shaving aid 50 substantially fills all of the holes 38. And, most preferably, the first layer of shaving aid 50 completely fills all of the holes 38. The shaving aid 30 is generally added in solid form (e.g., in a powder) and ultrasonically compressed to form a unitary solid body that generally matches the interior shape of the cavity 40 and holes 38. The compaction of the material further frictionally locks the first layer of shaving aid 50 into the desired position (i.e., in at least a portion the holes 38 and the portion of the cavity 40 adjacent the holes 38).

The shaving aid 30, preferably, includes 100% water soluble shaving aid materials, although water insoluble shaving aid materials are acceptable. For example, the shaving aid 30 can include any substance that enhances shaving performance. It may, for example, improve shaving comfort (e.g., by lubricating the skin, improve shaving efficiency, condition the beard, or condition the skin). Examples of appropriate shaving aids 30 include lubricous water-soluble polymers such as polyethylene oxide, polyvinyl pyrrolidone, polyacrylamide, hydroxyethyl cellulose, hydroxypropyl cellulose, polyvinyl imidazoline, polyhydroxyethylmethacrylate, poly vinyl alcohol. The preferred lubricous water-soluble polymer is polyethylene oxide. The more preferred polyethylene oxides will preferably have molecular weights of about 100,000 to 8 million, most preferably about 300,000 to 5 million. The most preferred polyethylene oxide comprises a blend of about 40 to 80% of polyethylene oxide having an average molecular weight of about 5 million and about 20 to 60% of polyethylene oxide having an average molecular weight of about 300,000.

The polyethylene oxide blend may also advantageously contain plasticizers. The use of the plasticizers allows the utilization of substantially lower temperatures during the time of processing to produce a flowability of the polyethylene oxide during ultrasonic compressing without substantially reducing its molecular weight. Preferred plasticizers are polyethylene glycol particularly with molecular weight between 400 and 20,000, water soluble polypropylene glycol particularly with molecular weight between 400 and 4,000, water-soluble copolymers of ethylene and propylene oxide, water-soluble alkyl phenol ethoxylates, glycerine, sorbitol and water. Particularly preferred plasticizers are propylene glycol and octyl phenol ethoxylate with 9 moles of ethylene oxide.

Additional ingredients to the shaving aid 30 can include:

A. A lubricating agent for reducing the frictional forces between the skin engaging elements and the skin, e.g., a micro-encapsulated silicone oil.

B. Any additional agent which reduces the drag between the skin engaging elements and the shaver's face, e.g., a non-ionic polyacrylamide; and/or a natural polysaccharide derived from plant materials such as "guar gum."

C. An agent which modifies the chemical structure of the hair to allow the at least one razor blade 106 to pass through the whiskers very easily, e.g., a depilatory agent is one example.

D. A cleaning agent which allows the whisker and skin debris to be washed more easily from the skin engaging elements during shaving, e.g., a silicon polyethylene oxide block copolymer and detergent such as sodium lauryl sulfate.

E. A medicinal agent for killing bacteria, or repairing skin damage and abrasions.

F. A cosmetic agent for softening, smoothing, conditioning or improving the skin.

G. A blood coagulant for the suppression of bleeding that occurs from nicks and cuts.

H. An astringent for constricting blood vessels thereby stemming the flow of bodily fluids such as lymph, which can exude from skin which has been irritated during shaving.

Additional layer(s) of shaving aid 54 can be added to the cavity 40 of the first portion of the lubrication box 28. In some embodiments, a designer may choose to have the subsequent layers 54 included in the lubrication box 102 be generally the same, if not identical, in amount and/or chemical composition to previous layer(s). However, a designer may prefer that a subsequent layer 54 be different than a previous layer in one or more aspects. For example, a subsequent layer 54 may be designed such that it is a different in amount, chemical composition, and/or color than a previous layer. Such a change could be used to provide a varied shaving benefit to the user and/or notify a user that, for example, the lubrication box 108 has almost reached its usable lifespan.

Figure 5:
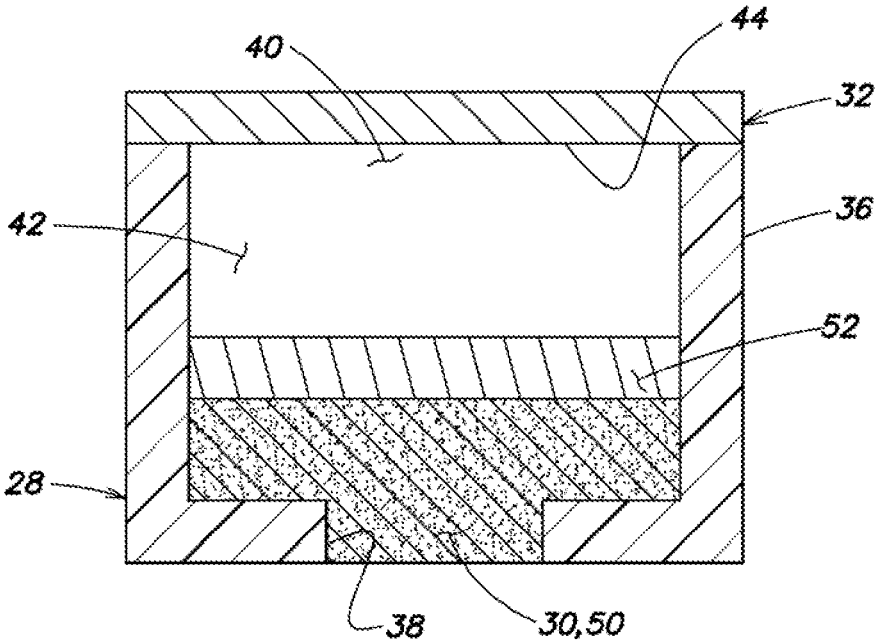
FIG. 5 depicts a cut-away view along line V-V of one embodiment of a second portion of the lubrication box affixed to the first portion of the lubrication box of FIG. 4A.
Figure 5A:
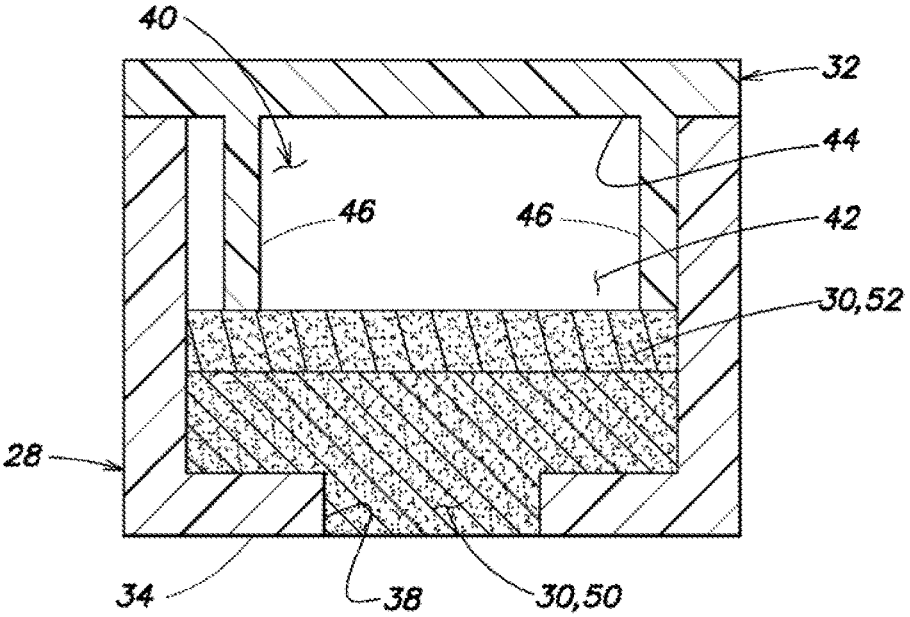
FIG. 5A depicts another embodiment of the second portion of the lubrication box of FIG. 3.
Figure 5B:
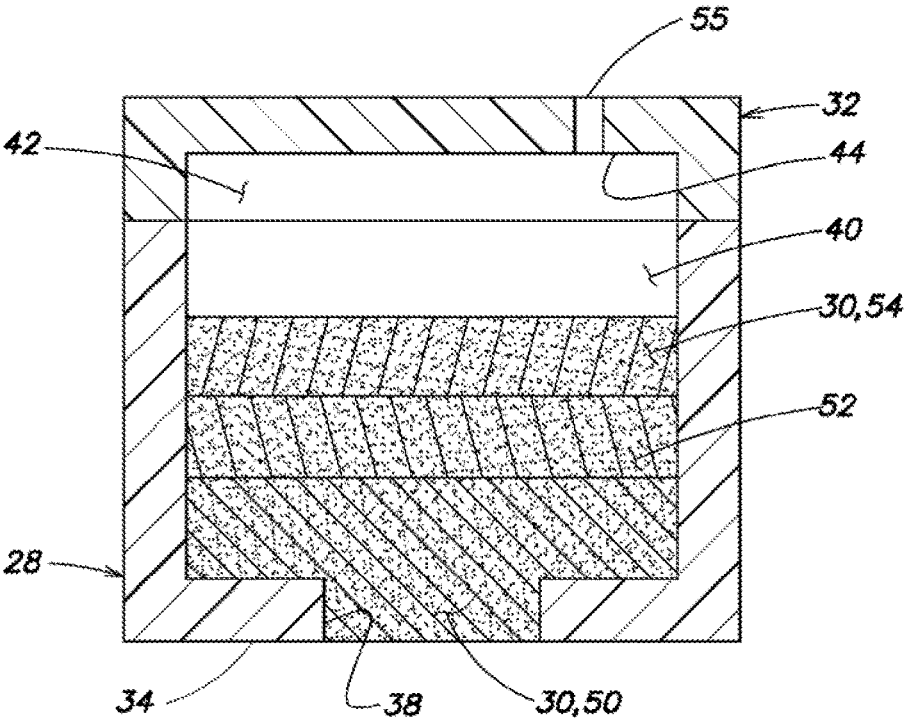
Figure 6:
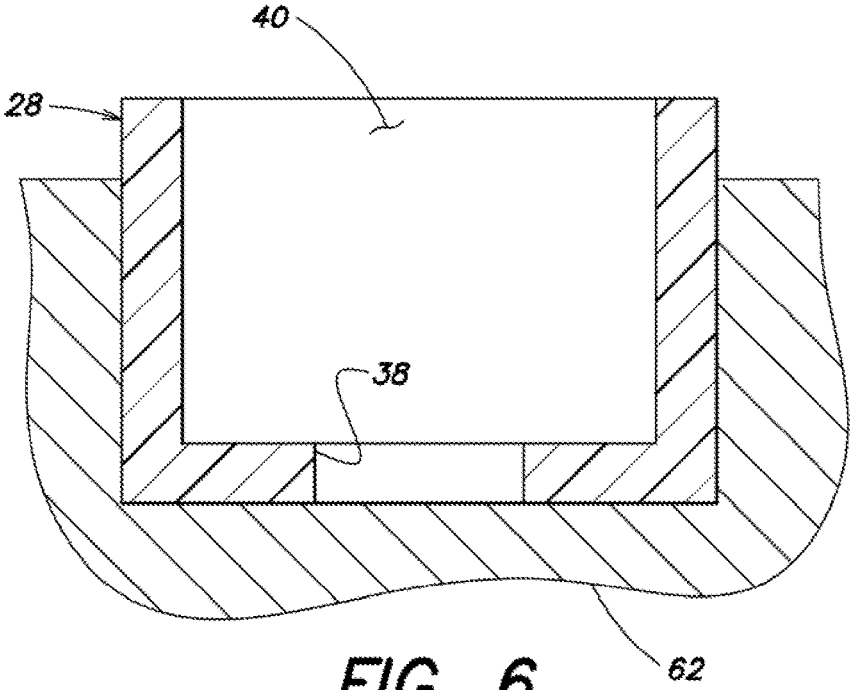
FIG. 6 depicts a step in the method of making a lubrication box.
Figure 6A:
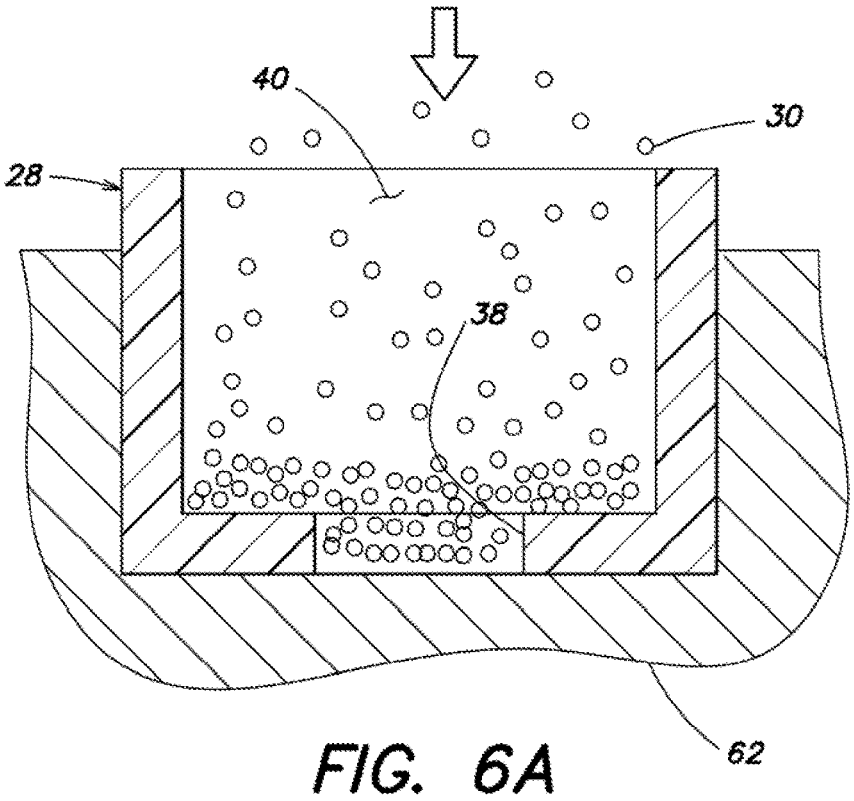
FIG. 6A depicts another step in the method of making a lubrication box.
Figure 6B:
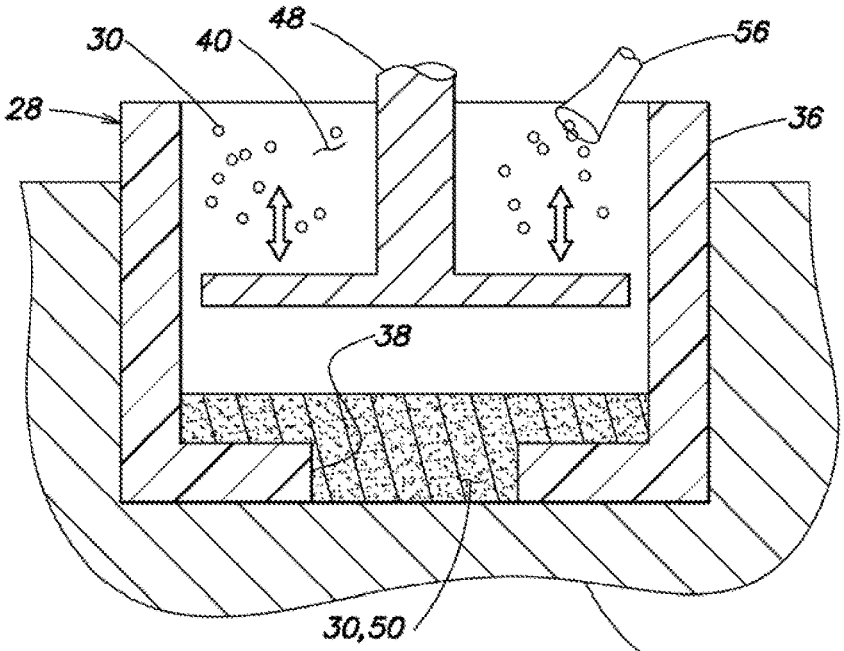
FIG. 6C depicts a further step in the method of making a lubrication box.
FIG. 6D depicts a further step in the method of making a lubrication box.
FIG. 6E depicts a further step in the method of making a lubrication box.
Figure 6C:
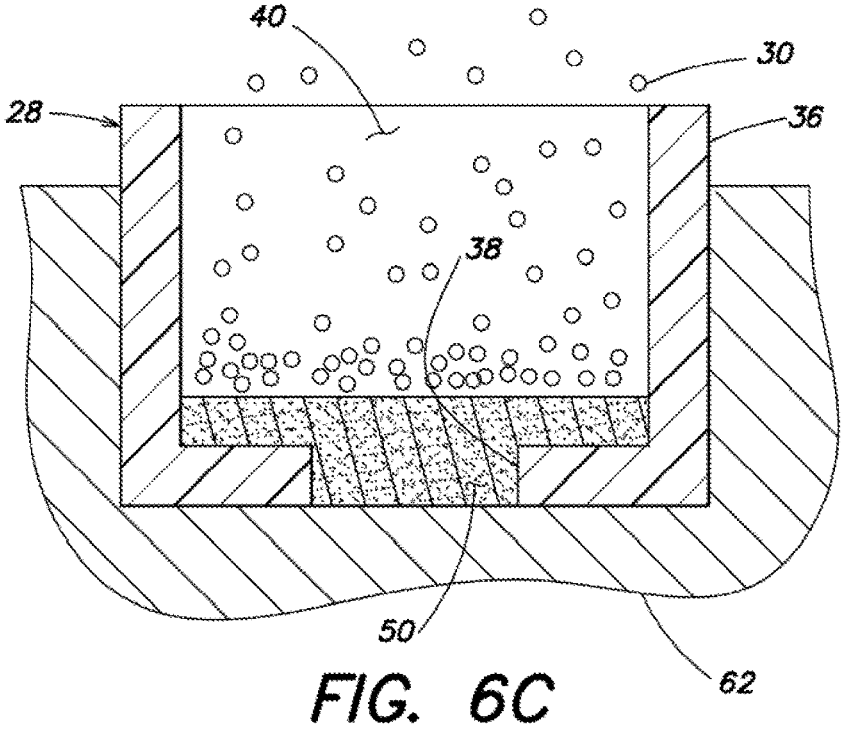
Figure 6D:
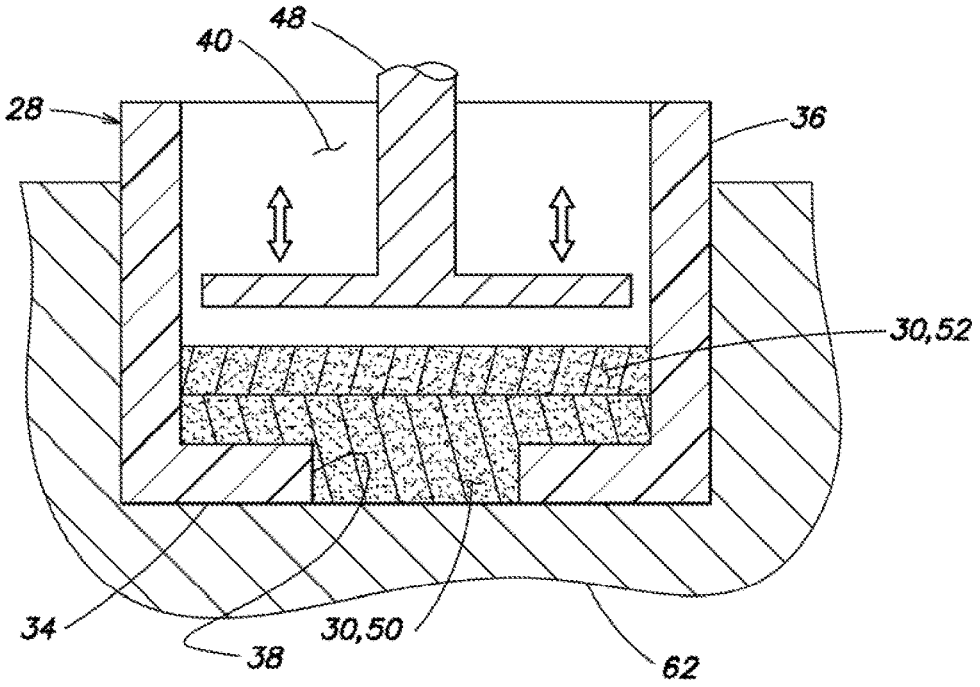
Figure 6E:
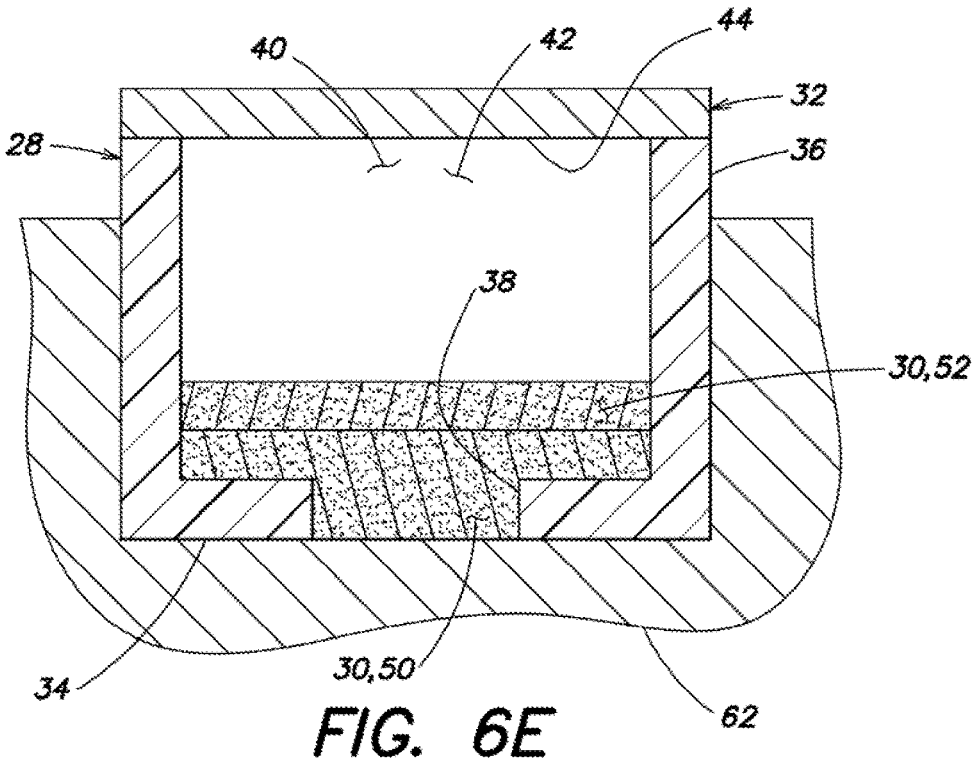

The second portion of the lubrication box 32, as shown in FIGS. 5, 5A and 5B, is affixed to the first portion of the lubrication box 28, substantially encasing the shaving aid 30 therein. The second portion of the lubrication box 32 can be of any suitable shape and size, provided that the second portion of the lubrication box 32 substantially covers the open end of the cavity 40 formed by the sidewall(s) 36 and skin-engaging surface 34 of the first portion of the lubrication box 28. In addition, the second portion of the lubrication box 32, preferably, is shaped such that a gap exists between the shaving aid 30 and the inner surface 44 of the second portion of the lubrication box 32. The air gap 42 provides space for the shaving aid 30 to expand when wetted. The expansion of the shaving aid 30 can, otherwise, cause an excessive amount of shaving aid 30 to exit through the at least two holes 38 and/or cause the first 28 and/or second portion of the lubrication box 32 to separate from one another, deform and/or crack.

The second portion of the lubrication box 32 can be made from any material; however, it is often preferable for the material to be made of plastic, metal or rubber. The second portion of the lubrication box 32 can be attached to the first portion of the lubrication box 28 in any suitable manner. The most suitable manner for attaching the two portions of the lubrication box 28, 32 often depends on the type of material used. For example, ultrasonically welding the two portions of the lubrication box 28, 32 together has been shown to have particular utility when, for example, the two portions of the lubrication box 28, 32 are made from plastic materials. However, the present invention is not so limited, and the two portions of the lubrication box 28, 32 can be glued or otherwise bonded together. In addition, in some embodiments, a physical connection (e.g., male/female connectors, press fit) is suitable.

The size of the gap between the shaving aid 30 and the second portion of the lubrication box 32 depends on a number of factors, including, but not limited to, the size of the lubrication box 108, and the amount of shaving aid 30 added to the cavity 40. In some cases, a small hole 55 through the first portion 28 or second portions of the lubrication box 32 (see e.g., FIG. 58) can assist to alleviate the build-up of excessive pressure inside the lubrication box 108 during normal use.

In some embodiments, and specifically referring to FIG. 5A, the second portion of the lubrication box 32 can include one or more additional support features 46 that extend into the cavity 40 that are in close proximity to, or in direct contact with, the shaving aid 30. During use, as water mixes with the shaving aid 30, a portion of the shaving aid 30 begins to dissolve. As more and more shaving aid 30 dissolves, the compacted shaving aid 30 will often, undesirably, become dislodged from its position in the cavity 40. The support feature(s) 46 tend to hold the shaving aid 30 forwards in the cavity 40 in close proximity to the at least two holes 38, where the shaving aid 30 is most likely to mix with water and provide the maximum shaving benefit to the skin during normal use. The support features 46 can be located adjacent the side wall(s) 36, and/or away from the side wall(s) 36 and towards the center of the cavity 40. Preferably, the support feature(s) 46 provide support for the shaving aid 30 at several locations within the cavity 40.

One method of making the shaving cartridge 102 of the present invention includes, first, providing a first portion of the lubrication box 28. As noted above, the first portion of the lubrication box 28 can be made of any suitable material by any known means (e.g., molding a plastic first portion of the lubrication box 28). The first portion of the lubrication box 28 is placed in a support nest 62 and a first amount of shaving aid 30 is distributed in the cavity 40.

Once the first amount of shaving aid 30 is distributed in the cavity 40 of the first portion of the lubrication box 28, a piston 48 then applies pressure one or more times, and provides an amount of ultrasonic energy (e.g., via an ultrasonic horn). The pressure of the piston and the ultrasonic energy act to ultrasonically compact the first amount of shaving aid 30, forming a first layer of shaving aid 50. For example, in an embodiment using 25-45 mg polyethylene oxide with a Vitamin E additive, the piston applies approximately 100-150 lbs of force, and 15-20 J of energy is provided by an ultrasonic source for approximately 0.1 to 0.2 seconds hold time during a single cycle. The actual number of times, length of time, amount of energy provided by the ultrasonic horn and/or amount of force applied by the piston may vary depending on numerous factors, including but not limited to the amount of shaving aid being compacted, the type of shaving aid being compacted, the actual size and shape of the lubrication box, and the desired level of compaction. The ultrasonic compaction process enables good compaction of materials while not subjecting active ingredients to conditions (e.g., high temperatures and/or pressures for extended periods of time) that tend to degrade the active ingredients in the shaving aid 30, thus hindering the ability of the materials to provide the intended shaving benefit. As a benefit of the ultrasonic compaction process, a high percentage of active ingredients in the shaving aid 30 survive and are available during normal use to provide the anticipated benefit.

Once the first layer of shaving aid 50 is formed, or compacted, a second amount of shaving aid 30 is, optionally, distributed into the cavity 40 of the first portion of the lubrication box 28. The above ultrasonic compaction process is repeated.

Optionally, once the second layer of shaving aid 52 is compacted, a third, fourth, or more layers of additional amounts of shaving aid 54 can be distributed and compacted within the cavity 40 of the lubrication box 108. During the compaction process, due to the speed of the piston 48, and the gap between the side edge of the piston 48 and the inner side of the side walls 36, shaving aid 30 particles are often stirred during the compaction process. A vacuum 56 can be provided to remove any portion of shaving aid 30 that is not compacted during the ultrasonic compaction process.

Once the shaving aid layer(s) 50, 52, 54 are compacted within the first portion of the lubrication box 28, the second portion of the lubrication box 32 is placed on the opening of the cavity 40 of the first portion of the lubrication box 28 and affixed. The lubrication box 108 is then affixed, directly or indirectly, to the frame 104 of the shaving cartridge 102 such that the skin-engaging elements are, or can be, in contact with the user's skin during normal shaving. In some embodiments, the lubrication box 108 is removable and replaceable on the frame 104 of the shaving cartridge 102.

In use, the shaving cartridge 102 is affixed to a handle 10 and a user wets the shaving cartridge 102. The water enters the at least two holes 38 of the lubrication box 108 and mixes with the shaving aid 30. The shaving aid 30, when wet, typically expands, filling at least a portion of the gap 42 within the lubrication box 108. Simultaneously, a portion of the shaving aid 30 dissolves in the water, and exits through the at least two holes 38. The shaving cartridge 102 is then put into contact with the user and drawn across the skin. The blade(s) 106 of the shaving cartridge 102 shave the hair as the now-dissolved shaving aid 102 is distributed on the skin, providing a benefit.

Only some embodiments of the present invention have been illustrated in the drawings, but it should be pointed out that many other modifications are conceivable within the scope of the following claims.

What is claimed is:

1. A method of making a lubrication box, the method comprising the steps of:

providing a first portion of the lubrication box, the first portion having a skin-engaging surface and at least one sidewall that forms a cavity, the skin-engaging surface having at least two holes therethrough;

distributing a first amount of shaving aid into the cavity of the first portion of the lubrication box;

ultrasonically compressing the first amount of shaving aid to form a first layer of shaving aid such that the first layer fills at least a portion of one of the holes;

providing a second portion of the lubrication box that covers an open end of the cavity of the first portion such that a gap remains between the ultrasonically compressed shaving aid and an inner surface of the second portion of the lubrication box; and affixing the second portion of the lubrication box to the first portion of the lubrication box.

2. The method of making a lubrication box of claim 1, wherein the step of providing a first portion of the lubrication box includes molding the first portion of a polymeric material.

3. The method of making a lubrication box of claim 1 wherein the step of providing a second portion of a lubrication box comprises providing a second portion of a lubrication box having support structures that extend into the cavity that are in close proximity to the shaving aid.

4. The method of making a lubrication box of claim 1 further including the step of removing any portion of shaving aid that is not compacted into the cavity.

5. The method of making a lubrication box of claim 1, wherein the second portion is disposed opposite of the skin-engaging surface such that the shaving aid in the cavity is between said second portion and the skin-engaging surface.

6. The method of making a lubrication box of claim 1, wherein the gap is an air gap.

7. A method of making a lubrication box, the method comprising the steps of:

providing a first portion of the lubrication box, the first portion having a skin-engaging surface and at least one sidewall that forms a cavity, the skin-engaging surface having at least two holes therethrough;

distributing a first amount of shaving aid into the cavity of the first portion of the lubrication box;

ultrasonically compressing the first amount of shaving aid to form a first layer of shaving aid such that the first layer fills at least a portion of one of the holes;

providing a second portion of the lubrication box that covers an open end of the cavity of the first portion such that a gap remains between the ultrasonically compressed shaving aid and an inner surface of the second portion of the lubrication box; and affixing the second portion of the lubrication box to the first portion of the lubrication box, wherein the method includes additional steps of distributing a second amount of shaving aid into the cavity of the first portion of the lubrication box onto the ultrasonically compressed first layer, then ultrasonically compressing the second amount of shaving aid to form a second layer of shaving aid that is adjacent to the first layer of shaving aid in the cavity such that the second layer fills at least a portion of the cavity.

8. The method of making a lubrication box of claim 7, wherein the method includes additional steps of distributing a third amount of shaving aid into the cavity of the first portion of the lubrication box onto the ultrasonically compressed second layer, then ultrasonically compressing the third amount of shaving aid to form a third layer of shaving aid that is adjacent to the second layer of shaving aid in the cavity such that the third layer fills at least a portion of the cavity.

9. The method of making a lubrication box of claim 7, wherein the step of providing a first portion of the lubrication box includes molding the first portion of a polymeric material.

10. The method of making a lubrication box of claim 7 wherein the step of providing a second portion of a lubrication box comprises providing a second portion of a lubrication box having support structures that extend into the cavity that are in close proximity to the shaving aid.

11. The method of making a lubrication box of claim 7 further including the step of removing any portion of shaving aid that is not compacted into the cavity.

12. The method of making a lubrication box of claim 7, wherein the second portion is disposed opposite of the skin-engaging surface such that the shaving aid in the cavity is between said second portion and the skin-engaging surface.

13. The method of making a lubrication box of claim 7, wherein the gap is an air gap.

14. A method of making a lubrication box, the method comprising the steps of:

providing a first portion of the lubrication box, the first portion having a skin-engaging surface and at least one sidewall that forms a cavity, the skin-engaging surface having at least two holes therethrough;

then distributing a first amount of shaving aid into the cavity of the first portion of the lubrication box;

then ultrasonically compressing the first amount of shaving aid to form a first layer of shaving aid such that the first layer fills at least a portion of one of the holes;

providing a second portion of the lubrication box that covers an open end of the cavity of the first portion such that a gap remains between the ultrasonically compressed shaving aid and an inner surface of the second portion of the lubrication box; and finally affixing the second portion of the lubrication box to the first portion of the lubrication box.

15. The method of making a lubrication box of claim 14, wherein the step of providing a first portion of the lubrication box includes molding the first portion of a polymeric material.

16. The method of making a lubrication box of claim 14, wherein the method includes additional steps of distributing a second amount of shaving aid into the cavity of the first portion of the lubrication box onto the ultrasonically compressed first layer, then ultrasonically compressing the second amount of shaving aid to form a second layer of shaving aid that is adjacent to the first layer of shaving aid in the cavity such that the second layer fills at least a portion of the cavity.

17. The method of making a lubrication box of claim 16, wherein the method includes additional steps of distributing a third amount of shaving aid into the cavity of the first portion of the lubrication box onto the ultrasonically compressed second layer, then ultrasonically compressing the third amount of shaving aid to form a third layer of shaving aid that is adjacent to the second layer of shaving aid in the cavity such that the third layer fills at least a portion of the cavity.

18. The method of making a lubrication box of claim 14 wherein the step of providing a second portion of a lubrication box comprises providing a second portion of a lubrication box having support structures that extend into the cavity that are in close proximity to the shaving aid.

19. The method of making a lubrication box of claim 14, wherein the second portion is disposed opposite of the skin-engaging surface such that the shaving aid in the cavity is between said second portion and the skin-engaging surface.

20. The method of making a lubrication box of claim 14, wherein the gap is an air gap.

* * * * *